US005456314A

United States Patent [19]

Boehm, Jr., et al.

[11] Patent Number: 5,456,314

[45] Date of Patent: Oct. 10, 1995

[54] WELLHEAD ANNULUS SEAL

[75] Inventors: Carl F. Boehm, Jr., Houston; David L. Ford, Katy; Herman O. Henderson, Jr., Houston, all of Tex.

[73] Assignee: ABB Vetco Gray Inc., Houston, Tex.

[21] Appl. No.: 253,659

[22] Filed: Jun. 3, 1994

[51] Int. Cl.[6] ..... E21B 33/04

[52] U.S. Cl. ..... 166/208; 166/217; 277/117; 277/236; 285/146; 285/348

[58] Field of Search ..... 166/115, 208, 166/134, 217; 277/117, 191, 206 R, 236, 165; 285/140, 141, 146

[56] References Cited

U.S. PATENT DOCUMENTS

| | | | |
|---|---|---|---|
| 2,687,909 | 8/1954 | Blackman et al. . | |
| 3,588,130 | 6/1971 | Flower et al. . | |
| 4,595,053 | 6/1986 | Watkins et al. | 166/115 X |
| 4,622,703 | 11/1986 | Cuschera | 277/191 X |
| 4,665,979 | 5/1987 | Boehm, Jr. | 277/117 X |
| 4,742,874 | 5/1988 | Gullion | 166/208 X |
| 4,751,965 | 6/1988 | Cassity | 277/117 X |
| 4,781,404 | 11/1988 | Tharp et al. . | |
| 4,932,472 | 6/1990 | Boehm, Jr. . | |
| 4,949,786 | 8/1990 | Eckert et al. | 166/208 |
| 4,960,172 | 10/1990 | Nelson | 166/208 |
| 5,060,724 | 10/1991 | Brammer et al. | 166/208 |
| 5,174,376 | 12/1992 | Singeetham | 166/208 |
| 5,246,236 | 9/1993 | Szarka et al. | 277/117 |
| 5,285,853 | 2/1994 | Eckert et al. | 166/115 X |

*Primary Examiner*—Ramon S. Britts
*Assistant Examiner*—Frank S. Tsay
*Attorney, Agent, or Firm*—James E. Bradley

[57] ABSTRACT

A seal for a wellhead housing employs a locking groove. The seal is of a U-shape, having an inner and outer radially spaced apart legs. An energizing ring is stroked downward to force the legs apart to cause them to seal between the wellhead housing in the conduit and the wellhead housing. At least one groove is located on one side of the energizing ring, with the groove being of a saw-toothed shape to allow entry but to resist upward movement of the energizing ring. In a metal version of a seal, the groove is located on the exterior of the energizing ring so as to allow some axial movement of the inner leg of the seal relative to the energizing ring. In a second version, the seal is of plastic.

15 Claims, 2 Drawing Sheets

WELLHEAD ANNULUS SEAL

BACKGROUND OF THE INVENTION

1. Field of the Invention

This invention relates in general to oil and gas wellhead assemblies, and in particular to an annulus seal for sealing between a casing hanger and a bore of a wellhead housing.

2. Description of the Prior Art

In wells of the type concerned herein, a wellhead housing will be located at the upper end of the well. The wellhead housing is a large tubular member having an axial bore extending through it. Casing will extend into the well and will be cemented in place. A casing hanger, which is on the upper end of the casing, will land within the wellhead housing. The exterior of the casing hanger is spaced from the bore of the wellhead housing by an annular clearance which provides a pocket for receiving an annulus seal.

There are many types of annulus seals, including rubber, rubber combined with metal, and metal-to-metal. One metal-to-metal seal in use has a U-shape, having inner and outer walls or legs separated from each other by an annular clearance. An energizing ring, which has smooth inner and outer diameters, is pressed into this clearance to force the legs apart to seal in engagement with the bore and with the exterior of the casing hanger. Wickers are located on the exterior of the casing hanger and in the bore of the wellhead housing. The outer leg embeds into the wickers of the bore while the inner leg embeds into the wickers of the casing hanger. This locks the annulus seal in place.

Temperature cycles can cause the casing hanger to move axially short distances relative to the wellhead housing. The temperature cycles are due to the production fluids flowing through the casing, the temperature cycles resulting in elongation and contraction of the casing. Because the inner and outer legs are embedded into wickers, the inner leg will tend to move with the axial movement of the casing hanger. The outer leg will remain stationary with the wellhead housing. Although unlikely, this slight relative axial movement between the inner and outer legs can conceivably cause the energizing ring to work upward from its energized position.

The U-shaped metal-to-metal seal described above works very well and does not deteriorate over many years of usage. However in some installations, the pressure expected to be encountered is not particularly high. In those installations, the cost of a metal seal may not justify the expected pressures. The prior art style rubber seals may deteriorate more quickly than desired.

SUMMARY OF THE INVENTION

In the first embodiment of this invention a metal seal is provided of the type that has a general U-shape and utilizes an energizing ring. The energizing ring has at least one groove contained on its outer diameter. Preferably, a number of the grooves are placed on the outer diameter, the grooves being circumferential and generally parallel to each other. Also, preferably the grooves are of a saw-toothed shape so that they will not impede the downward movement of the energizing ring during setting. Each groove has an upward facing shoulder which resists upward movement of the energizing ring relative to the seal. The grooves in this manner resist any upward movement of the energizing ring with the inner leg of the seal due to temperature growth movement of the casing hanger relative to the wellhead housing.

In the second embodiment, the seal is of entirely a plastic material. Preferably, the plastic material is ultra high molecular weight ("uhmw") polyethylene. The energizing ring is preferably of metal and contains one groove to resist upward movement of the energizing ring relative to the seal. In the second embodiment, the plastic seal is carried on a metal seal carrier which is a tubular conduit but is carried on the casing hanger.

DETAILED DESCRIPTION OF THE INVENTION

Figure 1:
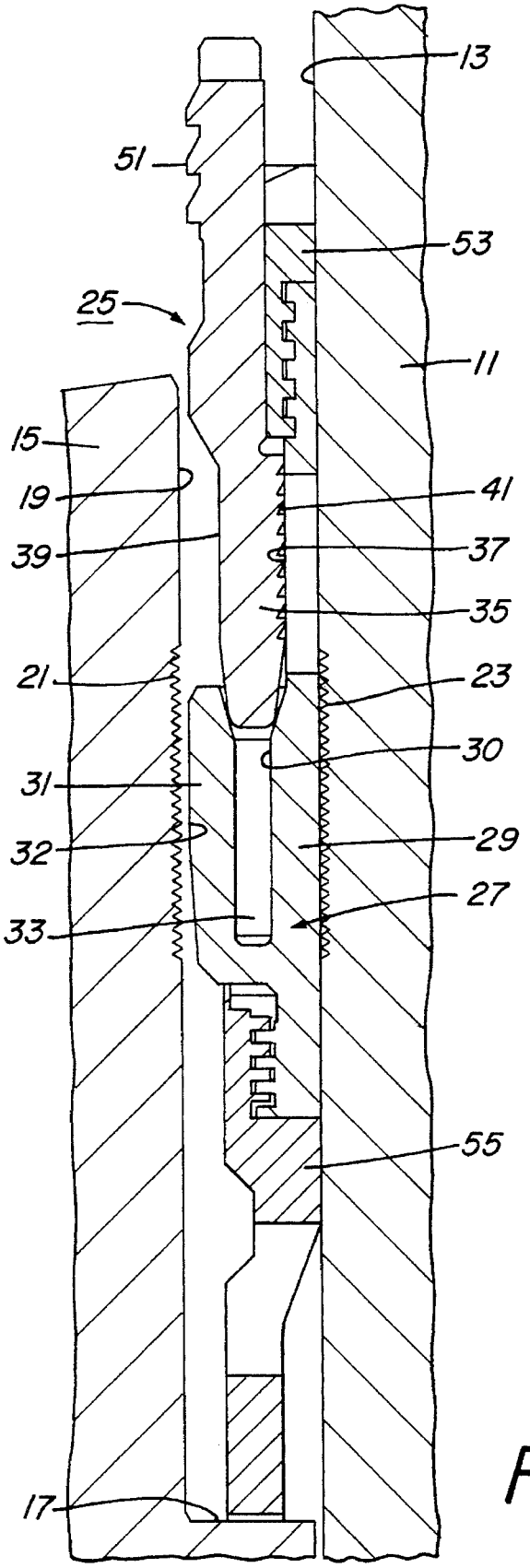
FIG. 1 is a partial quarter sectional view of a wellhead assembly having a seal constructed in accordance with this invention.

Reffering to FIG. 1, wellhead housing 11 is conventional. It is a large tubular member located at the upper end of a well, such as an offshore well. Wellhead housing 11 has an axial bore 13 extending through it. A casing hanger 15 lands in the wellhead housing 11. Casing hanger 15 is a tubular conduit secured to the upper end of a string of casing (not shown). Casing hanger 15 has an upward facing shoulder 17 on its exterior. The exterior wall 19 of casing hanger 15 is parallel to the wall of bore 13 but spaced inwardly. This results in an annular pocket or clearance between casing hanger exterior wall 19 and bore 13. A set of wickers 21 are located on the exterior wall 19 of casing hanger 15. A similar set of wickers 23 are located radially across on bore 13. Wickers 21, 23 are small triangular shaped, parallel, separate grooves. They are not threads.

A seal assembly 25 lands in the pocket between casing hanger exterior wall 19 and bore wall 13. Seal assembly 25 is made up entirely of metal components. These components include a generally U-shaped seal member 27. Seal member 27 has an outer wall or leg 29 and a parallel inner wall or leg 31, the legs 29, 31 being connected together at the bottom by a base and open at the top. The inner diameter 30 of outer leg 29 is radially spaced outward from the outer diameter 32 of inner leg 31. This results in an annular clearance 33 between legs 29, 31. The inner diameter 30 and the outer diameter 32 are smooth cylindrical surfaces parallel with each other. Similarly, the inner diameter of inner leg 31 and the outer diameter of outer leg 29 are smooth, cylindrical, parallel surfaces.

An energizing ring 35 is employed to force legs 29, 31 radially apart from each other into sealing engagement with wickers 21, 23. Energizing ring 35 has an outer diameter 37 that will frictionally engage the outer leg inner diameter 30. Energizing ring 35 has an inner diameter 39 that will frictionally engage the inner leg outer diameter 32. The radial thickness of energizing ring 35 is greater than the initial radial dimension of the clearance 33.

A set of teeth or grooves 41 are formed on the outer diameter 37 of energizing ring 35. Grooves 41 are of a saw-toothed shape so as to not impede downward movement of energizing ring 35 during the setting action. Each groove 41 has an upward facing flank 43 that is substantially perpendicular to the longitudinal axis of energizing ring 35. Each groove 41 has an inclined downward facing flank 45 that forms an acute angle of approximately 60 degrees relative to the upward facing flank 43. The flanks 43, 45 intersect each other at a root. On the outer diameter, a crest 47 separates each upward facing flank 43 from the downward facing flank 45. Each crest 47 is a cylindrical land. Grooves 41 extend circumferentially around the outer diameter 37 of energizing ring 35. In the embodiment shown, grooves 41 may be a single continuous helical recess, similar to a threadform, because sealing of the energizing ring 35 between the inner and outer legs 29, 31 is not required. If the seal assembly 25 utilized a test port (not shown) extending transversely through the legs 29, 31 and energizing ring 35, grooves 41 could be parallel and separate from each other so as to allow sealing of the energizing ring 35 between the legs 29, 31.

Figure 2:
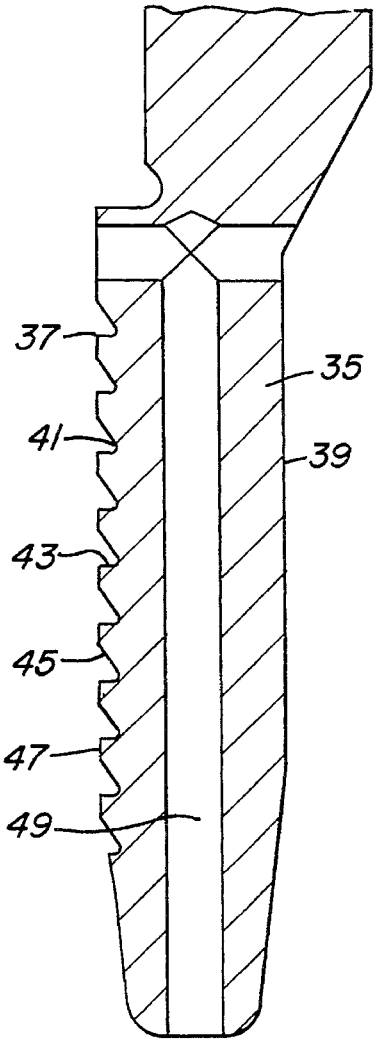
FIG. 2 is an enlarged portion of a part of the energizing ring employed with the seal of FIG. 2, and shown in a different sectional plane from that in FIG. 1, such that it appears to be in a mirror image.

As shown in FIG. 2, a displacement passage 49 extends upward from the lower end of energizing ring 35 to allow liquid to be displaced out of the seal clearance 33 during this setting action. A set of retrieving teeth 51, shown in FIG. 1, are located on the inner diameter 39 of energizing ring 41 at the upper end. Teeth 51 may be engaged by a retrieving tool (not shown) to pull energizing ring 35 from its lower position if retrieval is desired. A retainer ring 53, secured by threads to the upper portion of seal member 27, provides an upper stop for energizing ring 51 in its upper position. The lower position is not shown on the drawings. A lower extension 55 secures by threads to the lower portion of seal member 27. Lower extension 55 extends down into contact with shoulder 17.

In the operation of the embodiment of FIGS. 1 and 2, the running tool (not shown) will lower the seal assembly 25 into the pocket between the casing exterior wall 19 and wellhead housing bore 13, with the lower extension 55 abutting against shoulder 17. The outer diameter of outer leg 29 will be closely spaced to wickers 23. The inner diameter of seal member inner leg 31 will closely spaced to wickers 21. The running tool will then push the energizing ring 35 downward with great force. The energizing ring 35 will cause the inner and outer legs 31, 29 to move radially apart from each other. The inner diameter of inner leg 31 will embed into wickers 21 while the outer diameter of outer leg 29 will embed into wickers 23. During the downward movement of the energizing ring 35, the grooves 41 will have not hinder downward movement of the energizing ring 35 because of the saw-toothed configuration.

Subsequently, during production, hot well fluids may cause the casing to grow axially. If so, the casing hanger 15 may move upward relative to the wellhead housing 11. The inner leg 31 will move upward with the casing hanger 15, moving relative to the outer leg 29. The grooves 41 will grip the outer leg inner diameter 30, resisting any upward movement of energizing ring 35 relative to the outer leg 29. Some sliding movement between inner leg 31 and energizing ring 35 may occur, but energizing ring 35 will not move upward relative to wellhead housing 11. This gripping engagement tends to prevent energizing ring 35 from working its way out of the seal member 27.

Figure 3:
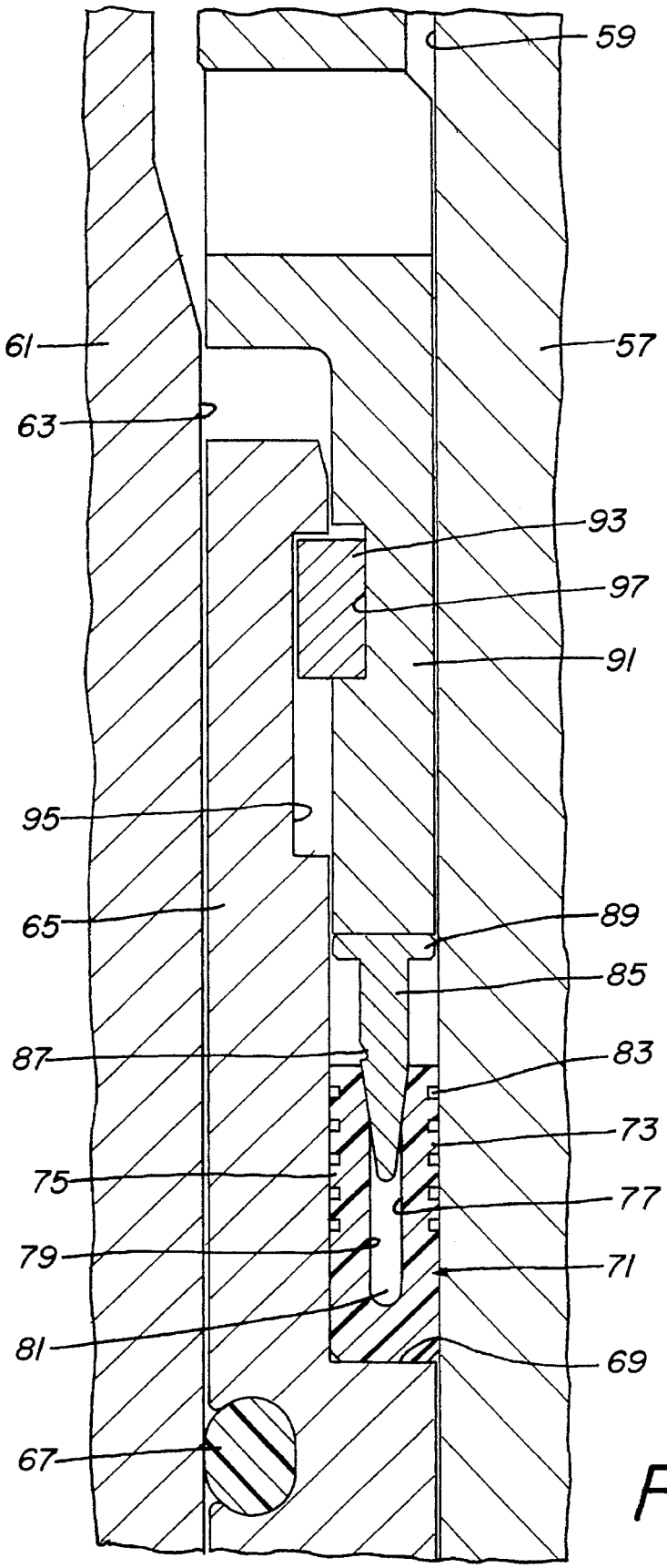
FIG. 3 is a quarter sectional partial view of an alternate embodiment of a wellhead assembly having a seal constructed in accordance with this invention.

Referring to FIG. 3, in this embodiment, a similar wellhead housing 57 is employed. Wellhead housing 57 has a axial bore 59, but unlike wellhead housing 11, has no wickers. A casing hanger 61 of a different type than casing hanger 15 is employed. Casing hanger 61 has an exterior 63 that is parallel and spaced from bore 59, and is also smooth, cylindrical and free of wickers. A seal carrier 65, which is a tubular conduit like casing hanger 61, is carried on the exterior of casing hanger 61 and may be considered a part of casing hanger 61. An o-ring 67 seals between seal carrier 65 and exterior 63. Seal carrier 65 has an upward facing shoulder 69.

A seal member 71 lands on shoulder 69. Seal member 71 is of a general U-shaped configuration. It has an outer leg 73 and an inner leg 75 connected by a base at the lower end. Outer leg 73 has an inner diameter 77 that is spaced from an outer diameter 79 of inner leg 75. The radial space or clearance 81 is open at the upper end. Preferably, separate, parallel grooves 83 are formed on the outer diameter of outer leg 73 and the inner diameter of inner leg 75. Grooves 83 are rectangular in cross-section and do not communicate with each other so as to aid in sealing. Grooves 83 are separated by cylindrical surfaces or lands.

Seal member 71 is constructed of a plastic material, preferably UHMW polyethylene. The preferred material is ASTM D4020. It has a tensile strength that is at least 6,300 psi. The tensile elongation is a minimum of 20%, and the hardness is a minimum of R-64.

An energizing ring 85 is employed to urge the legs 77, 79 apart from each other for sealing. The energizing ring 85 is preferably metal. It has a groove 87, which is shown on the inner diameter as an upward facing shoulder and a downward facing inclined shoulder that intersect each other at an acute angle. This gives groove 87 a general saw-toothed shape to resist movement of energizing ring 85 upward from its lower position. A head or flange 89 is located at the upper end of energizing ring 85, providing a general "T" shaped configuration. Energizing ring 85 has a radial thickness that is at a minimum at its lower end and gradually increases to groove 87. The maximum radial thickness is immediately above groove 87 and it remains constant up to head 89.

An actuating ring 91 bears against flange 89 for pushing it downward to the lower position. Actuating ring 91 is moved downward by running tool (not shown). A retainer ring 93, which is a metal member, locates in mating recesses 95, 97 in the actuating ring 91 and the casing hanger 65. Recess 95 has a greater axial length than recess 97 to allow the downward stroking of actuating ring 91.

In the operation of the embodiment of FIG. 3, seal carrier 65 is installed on casing hanger 61. Seal member 71 will be installed on shoulder 69. Actuating ring 91 is employed to stroke energizing ring 85 downward to cause the inner and outer legs 75, 73 to seal against bore 59 and the exterior of seal carrier 65.

The invention has significant advantages. In the first embodiment, the grooves placed on the outer diameter of the energizing ring grip the outer leg to prevent upward movement of the energizing ring with movement of the inner leg during temperature growth of the casing. The grooves do not detract from seal performance in setting and sealing. In the second embodiment, the plastic seal provides a seal for use in low pressure environments. The seal is less expensive than a metal type, yet has a longer life than rubber. The energizing ring groove helps resist any upward movement of the energizing ring.

While the invention has been shown only two of its forms, it should be apparent to those skilled in the art that it is not so limited, but it is susceptible to various changes without departing from the scope of the invention.

We claim:

1. In a seal for sealing between an outer diameter portion of a tubular conduit and an inner diameter portion of a wellhead housing, the seal having concentric, cylindrical inner and outer walls spaced apart from each other, an annular clearance located between the inner and outer walls, and an energizing ring which moves from an upper position spaced above the clearance to a lower position in the clearance, the energizing ring having inner and outer wall surfaces for forcing the inner and outer walls radially apart to seal respectively against the outer diameter portion of the conduit and the inner diameter portion of the wellhead housing, the improvement comprising:

at least one circumferentially extending groove located on one of the wall surfaces of the energizing ring for gripping one of the walls of the seal when in the lower position to assist in retaining the energizing ring within the clearance; and wherein the other of the wall surfaces of the energizing ring engages the other of the walls of the seal, said other of the wall surfaces of the energizing ring being smooth and free of grooves to allow slight axial movement between said other of the walls of the seal and said other of the wall surfaces of the energizing ring.

2. The seal according to claim 1 wherein the groove has a saw-toothed configuration having an upward facing flank that is generally perpendicular to a longitudinal axis of the energizing ring and an inclined downward facing flank that forms an acute angle with the upward facing flank.

3. The seal according to claim 1 wherein the groove is located on the outer wall surface.

4. The seal according to claim 1 wherein:

the inner and outer walls of the seal are formed of a plastic material.

5. The seal according to claim 1 wherein the inner and outer walls of the seal are formed of polyethylene.

6. In a seal for sealing between an outer diameter portion of a tubular conduit and an inner diameter portion of a wellhead housing, the seal having concentric, cylindrical inner and outer walls spaced apart from each other, an annular clearance located between the inner and outer walls, and an energizing ring which moves from an upper position spaced above the clearance to a lower position in the clearance, forcing the inner and outer walls radially apart to seal respectively against the outer diameter portion of the conduit and the inner diameter portion of the wellhead housing, the improvement comprising:

at least one circumferentially extending groove located on the energizing ring which engages one of the walls of the seal when in the lower position to assist in retaining the energizing ring within the clearance; and wherein the energizing ring has inner and outer surfaces, wherein the groove is located on the outer surface, and wherein the inner surface is smooth so as to allow slight axial movement of the conduit and inner wall of the seal relative to the energizing ring.

7. In a seal for sealing between an outer diameter portion of a tubular conduit and an inner diameter portion of a wellhead housing, the seal having concentric, cylindrical inner and outer walls spaced apart from each other, an annular clearance located between the inner and outer walls, and an energizing ring which moves from an upper position spaced above the clearance to a lower position in the clearance, forcing the inner and outer walls radially apart to seal respectively against the outer diameter portion of the conduit and the inner diameter portion of the wellhead housing, the improvement comprising:

at least one circumferentially extending groove located on the energizing ring which engages one of the walls of the seal when in the lower position to assist in retaining the energizing ring within the clearance; wherein:

there are a plurality of the grooves, each having a saw-toothed configuration with an upward facing shoulder;

the energizing ring has inner and outer surfaces, with the grooves located on the outer surface for engagement with the outer wall of the seal, the saw-toothed configuration being oriented upward to allow downward movement of the energizing ring relative to the seal but resist upward movement of the energizing ring relative to the outer wall of seal when the energizing ring is in the lower position; and the inner surface of the energizing ring is smooth so as to allow slight axial movement of the conduit and inner wall of the seal relative to the energizing ring.

8. In a seal assembly for sealing between a tubular conduit and an axial bore of a wellhead housing, the seal assembly having a metal seal member with concentric, cylindrical, smooth inner and outer walls spaced apart from each other, an annular clearance located between the inner and outer walls, and an energizing ring which moves from an upper position spaced above the clearance to a lower position in the clearance, the energizing ring having inner and outer wall surfaces which engage and force the inner and outer walls of the seal member radially apart to seal against respectively against the conduit and the bore, the improvement comprising:

a plurality of circumferentially extending grooves located on one of the wall surfaces of the energizing ring, the grooves being of a saw-toothed configuration to avoid impeding insertion of the energizing ring into the clearance and to engage one of the walls of the seal member when in the lower position to assist in retaining the energizing ring within the clearance; and wherein the other of the wall surfaces of the energizing ring engages the other of the walls of the seal member, said other of the wall surfaces of the energizing ring being smooth and free of grooves to allow slight axial movement between aid other of the walls of the seal member and said other of the wall surfaces of the energizing ring due to hot well fluids being produced through the conduit, causing the conduit to move axially relative to the wellhead housing.

9. The seal assembly according to claim 8 wherein each of the grooves has an upward facing flank generally perpendicular to a longitudinal axis of the energizing ring, and an inclined downward facing flank that is at an acute angle relative to the upward facing flank.

10. The seal assembly according to claim 8 wherein each of the grooves has an upward facing flank generally perpendicular to a longitudinal axis of the energizing ring, an inclined downward facing flank that is at an acute angle relative to the upward facing flank, and a crest on the outer surface of the energizing ring located between each of the flanks, the crest being a cylindrical surface.

11. A wellhead assembly, comprising in combination:

a wellhead housing having an axial bore;

a tubular conduit located within the bore;

a seal assembly located between the conduit and the bore, the seal assembly having a seal member having concentric, cylindrical inner and outer walls spaced apart from each other, an annular clearance between the inner and outer walls, the seal member being formed of a plastic material;

an energizing ring which which has inner and outer wall surfaces and which moves from an upper position spaced above the clearance to a lower position in the clearance, forcing the inner and outer walls radially apart to seal respectively against the conduit and the bore;

a circumferentially extending groove located on one of the wall surfaces of the energizing ring, the groove being of a saw-toothed configuration to avoid impeding insertion of the energizing ring into the clearance and to engage one of the walls of the seal member when in the lower position to assist in retaining the energizing ring within the clearance;

the energizing ring having a head on its upper end which locates above the upper end of the clearance when the energizing ring is in the lower position; and the energizing ring having a radial thickness from a lower end of the energizing ring of the head that is at a maximum thickness immediately above the groove and remains constant at said maximum thickness from the groove to the head.

12. The wellhead assembly according to claim 11 wherein the plastic material of the seal member is of polyethylene.

13. The wellhead assembly according to claim 11 wherein the plastic material of the seal member is of ultra high molecular weight polyethylene.

14. The wellhead assembly according to claim 11 wherein the other of said wall surfaces of the energizing ring is smooth and free of grooves.

15. The wellhead assembly according to claim 11 wherein the inner wall of the seal member has an inner diameter containing a plurality of circumferential, parallel, separate grooves, and the outer wall of the seal member has an outer diameter containing a plurality of circumferential, parallel, separate grooves, the grooves on each of the walls being separated from each other by cylindrical surfaces so as to assist in sealing against the conduit and the wellhead housing.

* * * * *